US009616552B1

(12) United States Patent
McClain

(10) Patent No.: US 9,616,552 B1
(45) Date of Patent: Apr. 11, 2017

(54) HANDGUN SLIDE AND FRAME WORKPIECE

(71) Applicant: Aaron McClain, Comanche, OK (US)

(72) Inventor: Aaron McClain, Comanche, OK (US)

( * ) Notice: Subject to any disclaimer, the term of this patent is extended or adjusted under 35 U.S.C. 154(b) by 0 days.

(21) Appl. No.: 14/756,718

(22) Filed: Oct. 1, 2015

(51) Int. Cl.
*B25B 1/00* (2006.01)
*B25B 1/24* (2006.01)
*F41C 3/00* (2006.01)

(52) U.S. Cl.
CPC ..... *B25B 1/2463* (2013.01); *F41C 3/00* (2013.01)

(58) Field of Classification Search
CPC B25B 1/2463; B25B 1/02; B25B 1/14; B25B 1/2452; B25B 1/00; B25B 3/00; B25B 5/00; B25B 7/00; F41C 3/00
See application file for complete search history.

(56) References Cited

U.S. PATENT DOCUMENTS 4,688,779 A * 8/1987 Dornfeld ..... B25B 1/103 269/244
D346,196 S 4/1994 Ruger
5,503,276 A 4/1996 Pierce
8,727,294 B1 5/2014 Harms

* cited by examiner

*Primary Examiner* — Larry E Waggle, Jr.
*Assistant Examiner* — Nirvana Deonauth
(74) *Attorney, Agent, or Firm* — Randal D. Homburg

(57) ABSTRACT

A workpiece for securing the slide and frame components of a variety of polymeric handgun, the workpiece secured within a vise to alternatively anchor the slide components within linear channels within the sides of the upper extension of the workpiece or anchor the slide extensions incorporated within the inverted frame component within transverse mounted side clamping members attaching through appropriately selected plurality of transverse bores within the workpiece, the workpiece providing a secure attachment for each component for tooling, repair, modification or other gunsmith related activities without damage to the components.

3 Claims, 6 Drawing Sheets

HANDGUN SLIDE AND FRAME WORKPIECE

CROSS REFERENCE TO RELATED APPLICATIONS

None

I. BACKGROUND OF THE INVENTION

1. Field of Invention

A workpiece for securing the slide and frame components of a variety of polymeric handguns, the workpiece secured within a vise to alternatively anchor the slide components within linear channels within the sides of the upper extension of the workpiece or anchor the slide extensions incorporated within the inverted frame component within transverse mounted side clamping members attaching through appropriately selected plurality of transverse bores within the workpiece, the workpiece providing a secure attachment for each component for tooling, repair, modification or other gunsmith related activities without damage to the components.

2. Description of Prior Art

A preliminary review of prior art patents was conducted by the applicant which reveal prior art patents in a similar field or having similar use. However, the prior art inventions do not disclose the same or similar elements as the present handgun slide and frame workpiece, nor do they present the material components in a manner contemplated or anticipated in the prior art.

A handgun holding system is disclosed in U.S. Pat. No. 8,727,294 to Harms which secures a fully assembled handgun is a side mounting position within adjustable clamping members. It does not independently secure a slide and a frame component of a handgun in a position for any gunsmith or repair activities. In U.S. Pat. No. 5,503,276 to Pierce, a handgun stand is provided by an angular frame member having a plurality of horizontal post extensions upon which the barrel of a handgun is placed to support one or more handguns.

Two products exist for sale which provide a means for securing handgun slide and frame components. The first appears to be called a Yavapai 1911 Auto Slide Jig which was located at http://www.brownells.com per the attached related reference. It demonstrates a jig which provides for the engagement of a handgun slide component. In another related reference, a 1911 Extractor Drilling Jig for drilling a hole in the ejector mounted within the frame of a handgun is found at http://grabcad.com per another attached related reference. This jig mounts to part of the frame to provide a drilling guide for a drill bit to drill a hole through either the extractor or the ejector of a 1911 frame handgun according to the limited information found on that website. It is unknown when these devices were published and no patent reference was found for either of these items.

The present workpiece defines an L-shaped metal or composite fixture which can be mounted within a standard bench vise with the lower vise section secured within the vise extending a component mounting section. Along the lateral side section of the component mounting section are linear side grooves which accept the inner linear slide channels within the slide portion of a handgun which normally engage the slide channel extension of the handgun frame. The workpiece includes a plurality of vertical threaded bores, each bore threadably engaging an externally threaded set screws to secure the handgun slide. The component mounting section also provides a plurality of transverse bores, each bore providing a selected location for the application of a pair of slide extension clamping assemblies for securing the slide mounting extensions of the inverted handgun frame.

II. SUMMARY OF THE INVENTION

Polymer composite handguns are a lighter weight alternative to full metal handguns. They have gained popularity in law enforcement, the military and with civilian owners. Polymeric handguns are generally provided with a milled metal slide with lateral slide grooves engaged with a frame. The frame is made of a polymeric material, commonly a high carbon plastic and includes metal attachments and internal components including the firing mechanism, the trigger mechanism, and the slide extensions, the slide extensions being the means by which the lateral slide grooves of the slide connect for the operation of the handgun.

These handguns commonly are subject to repair, maintenance and modification by their owners or by professional gunsmiths. During these operations, its is preferable that a secure means to hold the components is provided which will not subject the handgun components to damage, tool marking or deformation. Typical procedures which benefit from a secure mounting means include milling, extractor modification, front cocking serrations, side cuts, lowering of ejection ports, primary compensator cuts, grip enhancement, sight improvement or exchange and upgrade, painting, bluing, sandblasting and retooling. The present workpiece is held within a vise or other anchoring means, with the workpiece retaining the handgun components without deformation, marking, scratching or pressure at locations not intended for such pressure application, engaging the reinforced components of the handgun pieces, specifically the slide and the frame, along those portions of the slide and frame most durable for anchor during the above operations.

III. DESCRIPTION OF THE DRAWINGS

The following drawings are submitted with this utility patent application.

FIG. 6 is an exploded view of the workpiece components.

IV. DESCRIPTION OF THE PREFERRED EMBODIMENT

Figure 1:
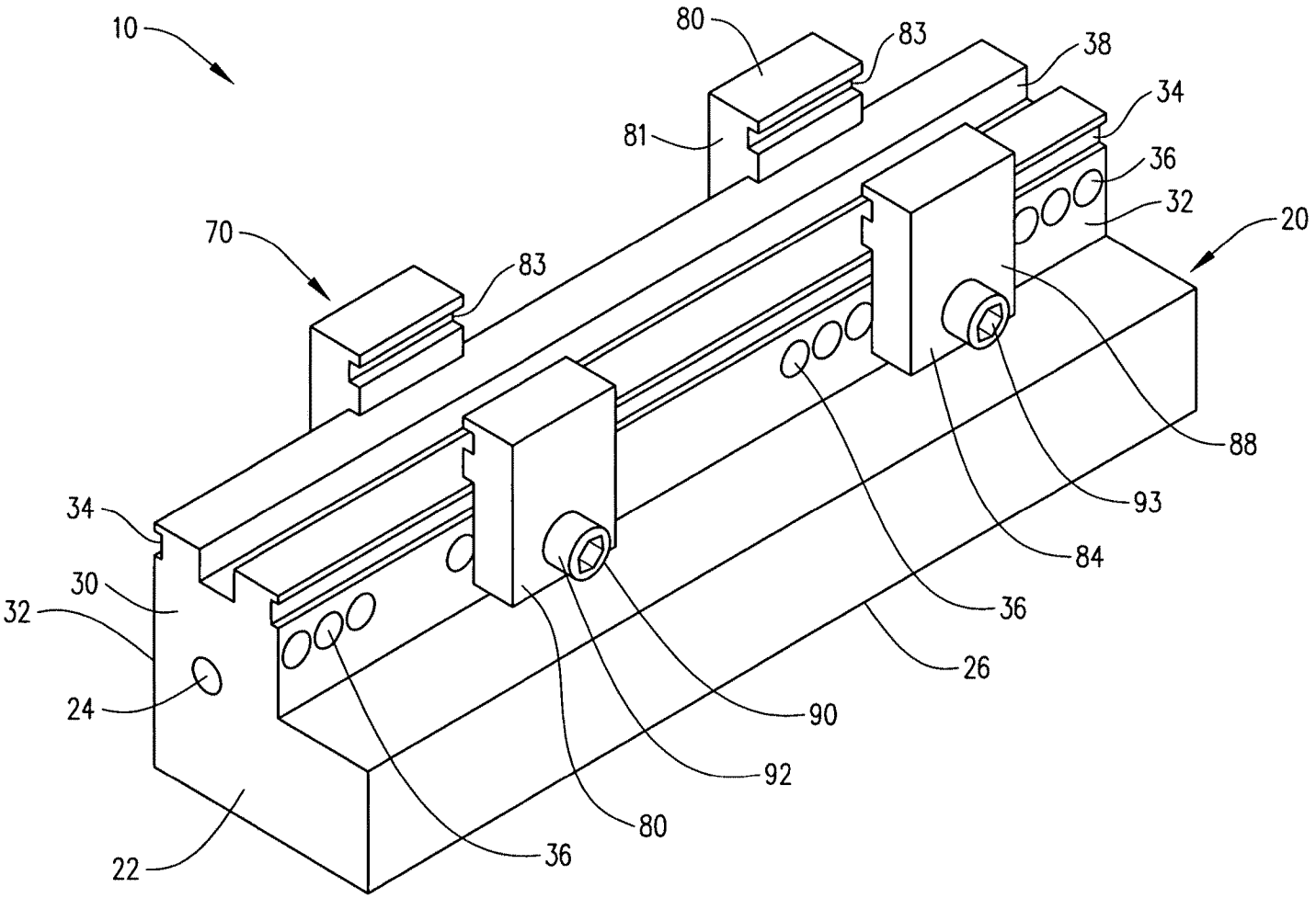
FIG. 1 is an upper perspective view of the handgun slide and frame workpiece.
Figure 2:
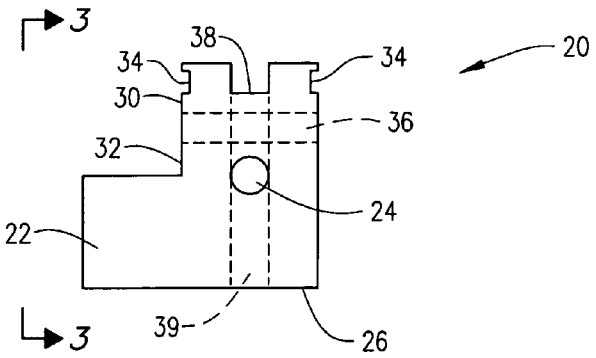
FIG. 2 is an end view of the base member of the workpiece.
Figure 3:
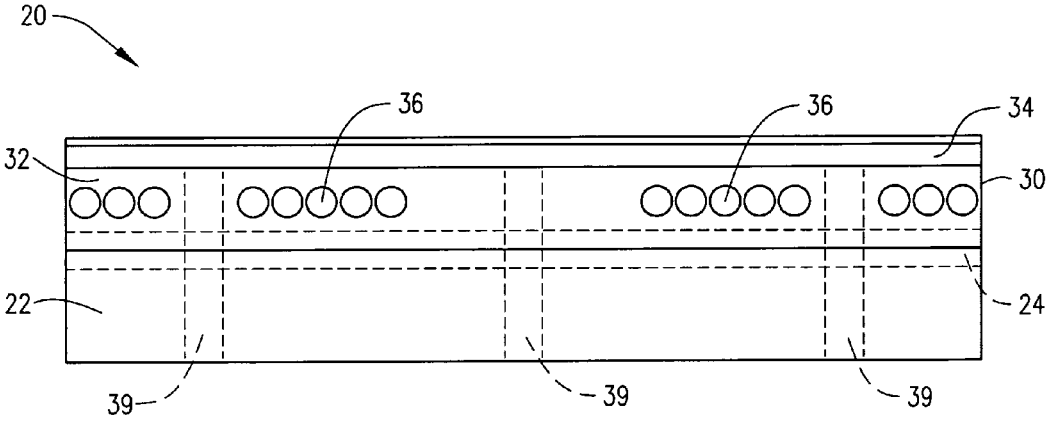
FIG. 3 is a sectional view of the base member along section lines 3/3 of FIG. 2.
Figure 4:
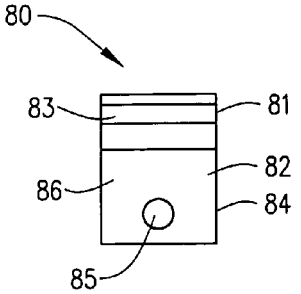
FIG. 4 is an inner surface view of the frame support clamping element.
Figure 5:
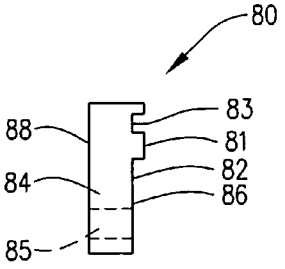
FIG. 5 is a side view of the frame support clamping element.
Figure 5:
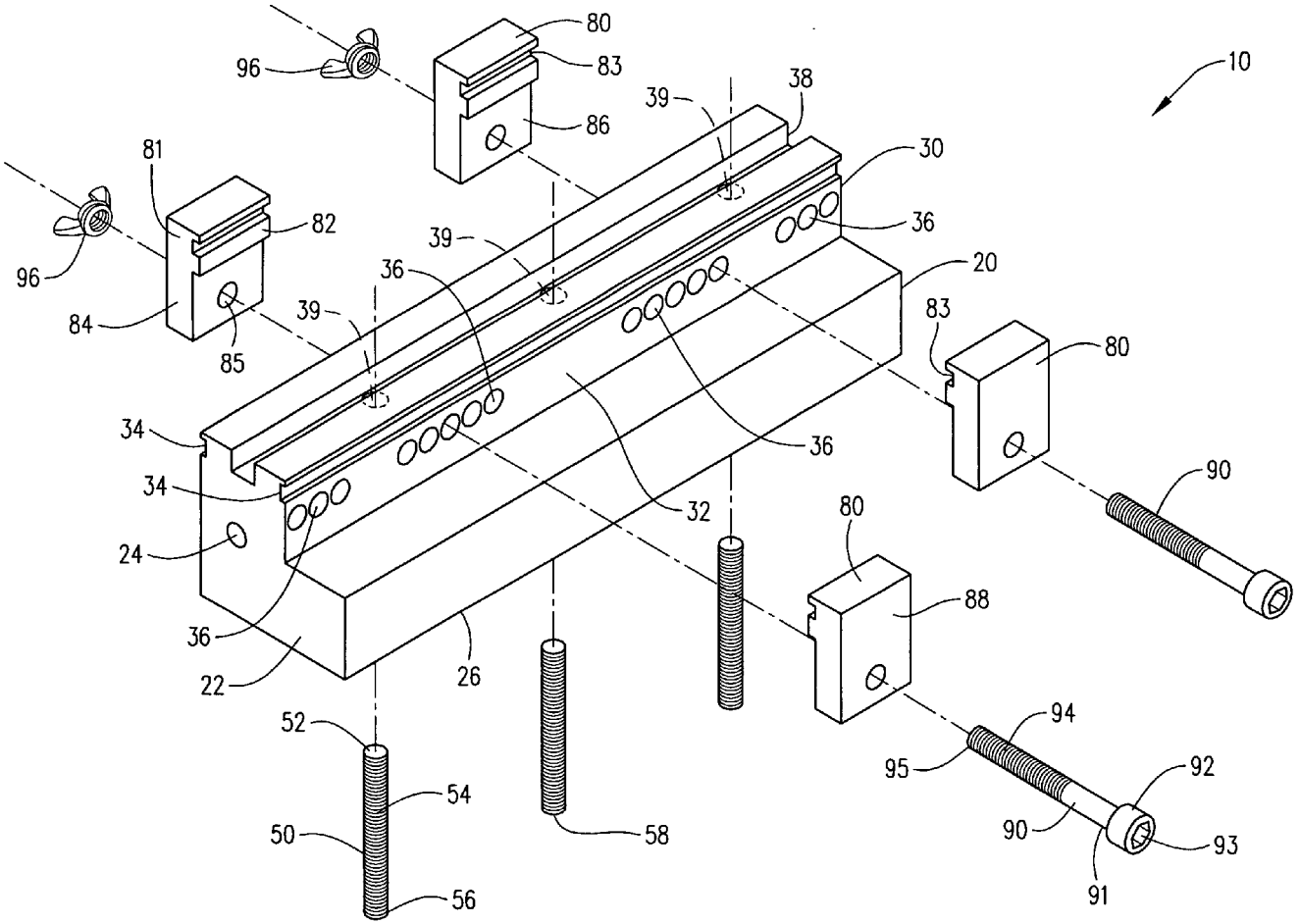
Figure 7:
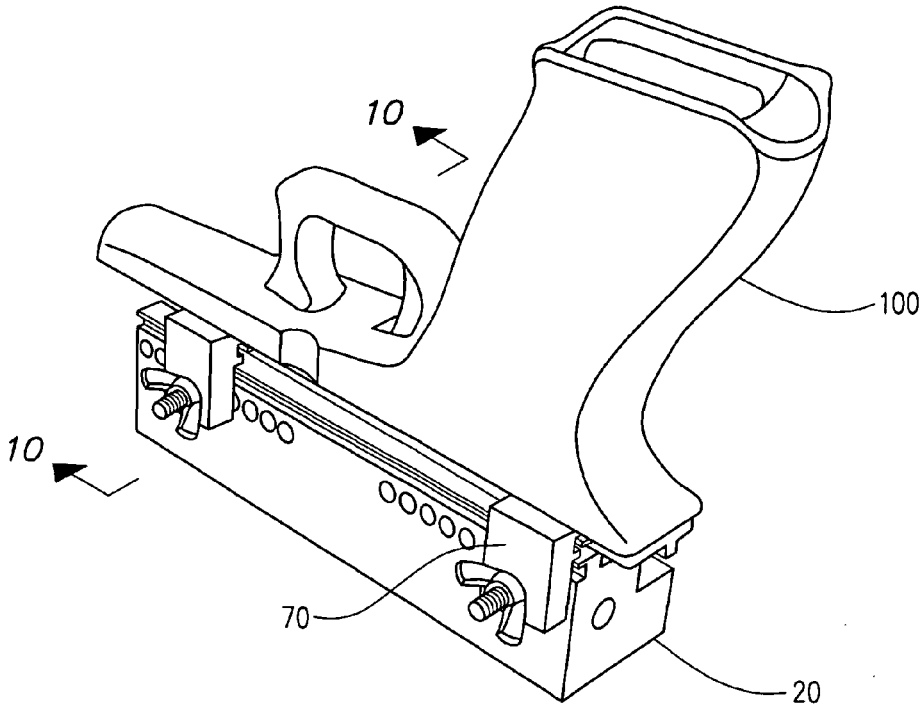
FIG. 7 is an upper perspective view of the workpiece mounting the frame of a handgun.
Figure 8:
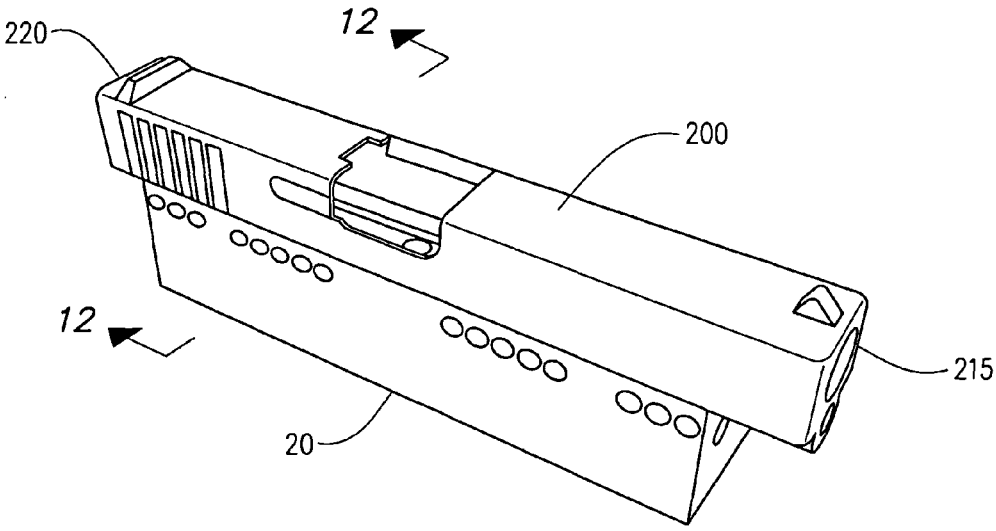
FIG. 8 is an upper perspective view of the workpiece mounting the slide of a handgun.
Figure 9:
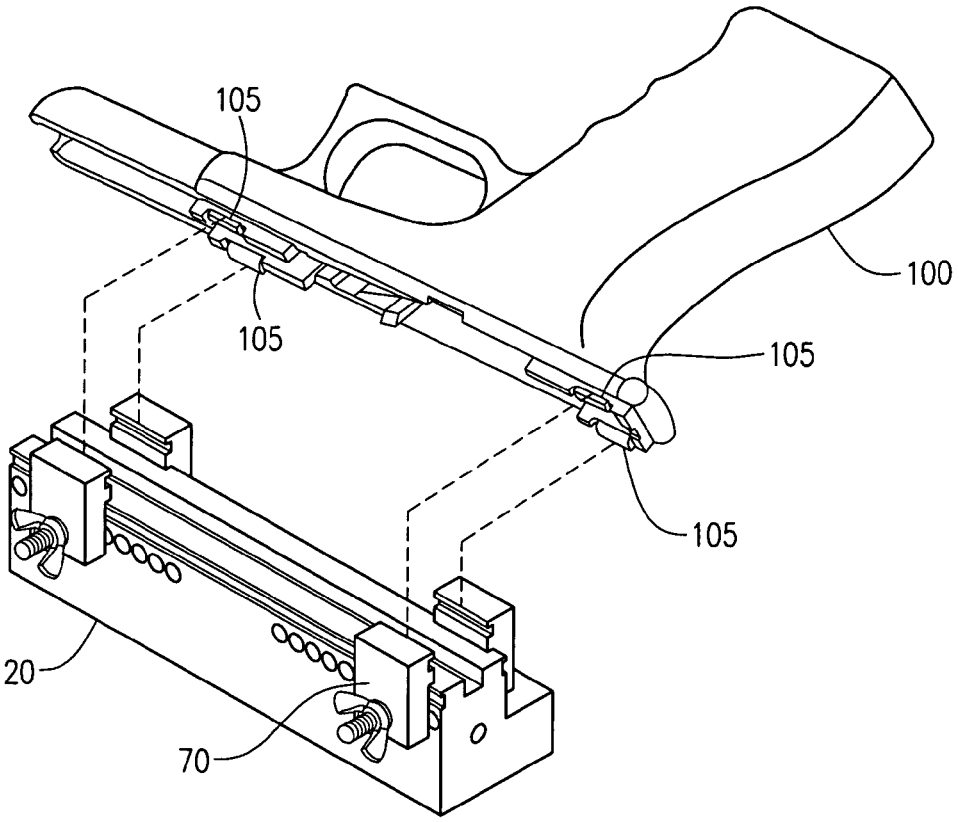
FIG. 9 is a view of the frame of the handgun indicating the attachment of the frame slide projections as mounting within the frame support clamping assembly.
Figure 10:
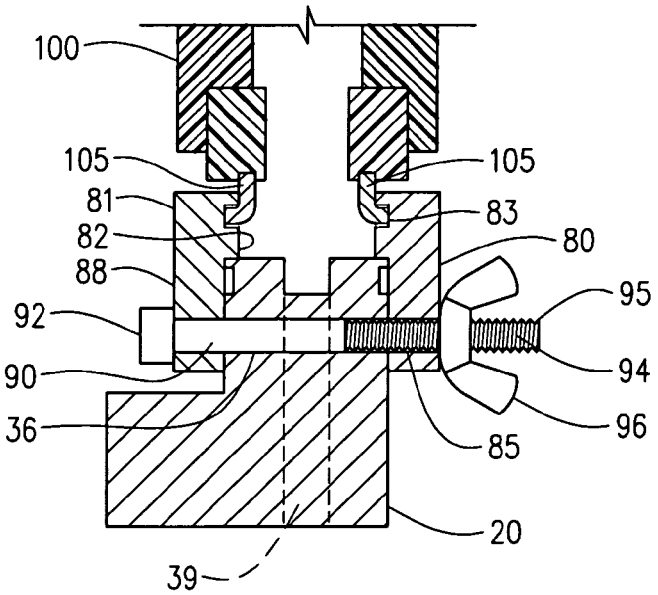
FIG. 10 is a cross-sectional view along section lines 10/10 of FIG. 7.
Figure 11:
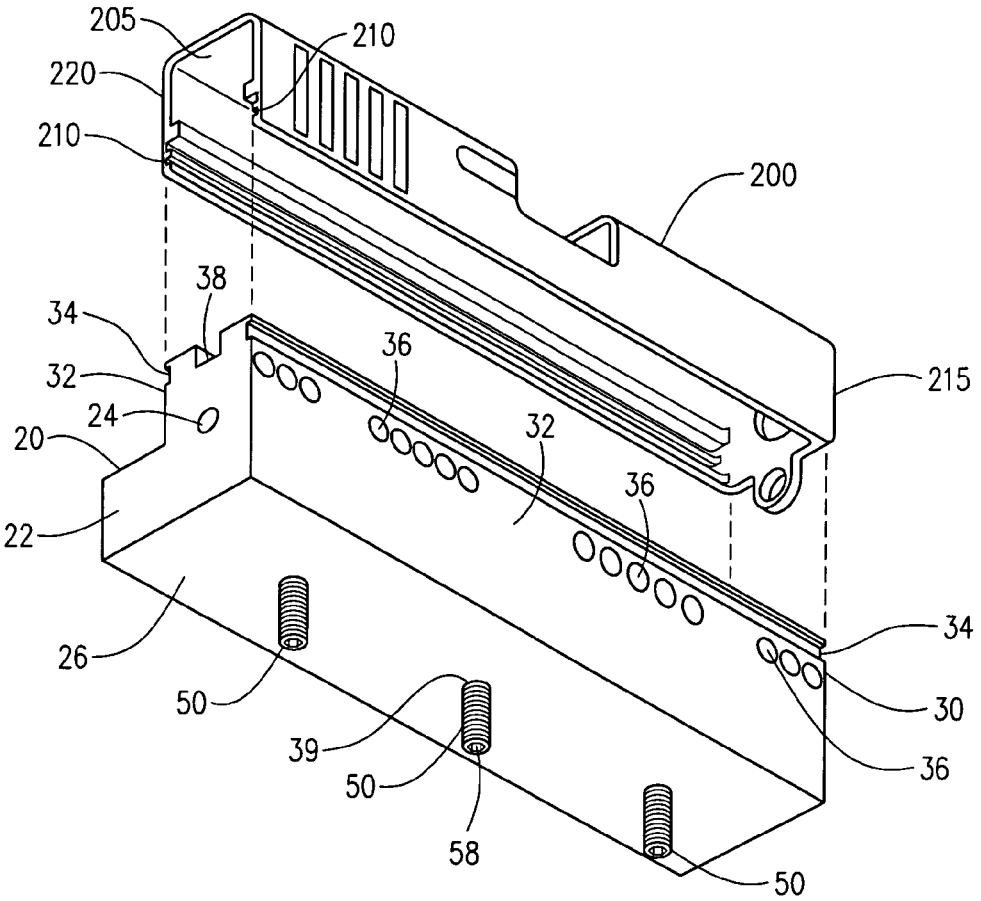
FIG. 11 is a view of the slide of the handgun indicating the attachment of the slide of the handgun as mounting upon the upper slide grooves on the lateral surfaces of the upper support extension of the base member.
Figure 12:
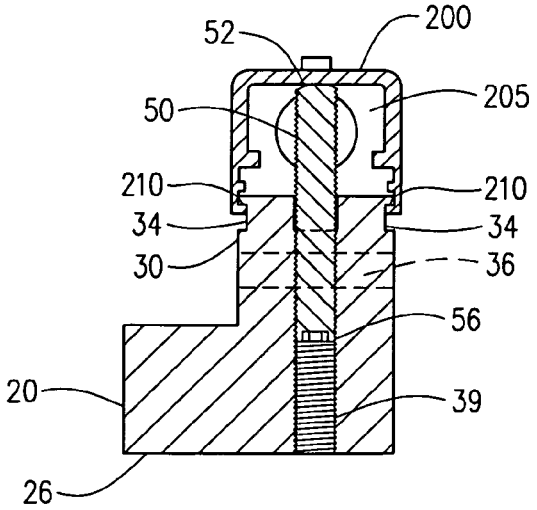
FIG. 12 is a cross-sectional view along section lines 12/12 of FIG. 8.

A workpiece 10 securing a slide 200 and a frame 100 component of a variety of semi-automatic handguns, especially those having polymeric component frames, as shown in FIGS. 1-12 of the drawings, the workpiece 10 comprising a L-shaped base member 20 defining a threaded axial bore 24, a lower clamping section 22 having a lower surface 26 and extending an upper support platform 30 defining lateral surfaces 32 including axially aligned upper slide grooves 34 on each lateral surface 32, the lateral surface 32 also providing a plurality of aligned transverse clamping bores 36 below the upper slide grooves 34, the upper support platform 30 further defining an upper axial channel 38 and at least two threaded vertical anchor bores 39 extending from the axial channel 38 to the lower surface 26 of the lower clamping section 22, at least two anchor bolts 50 having outer threads 54, each anchor bolt 50 engaged within a respective vertical anchor bore 39 with an upper contact tip 52 extending through the axial channel 38 and a lower end 56 defining a tool indentation 58 to rotate each anchor bolt 50 while engaged within the vertical anchor bore 39, and a frame support clamping assembly 70 defining at least two pair of clamp members 80 engaging a common clamp bolt 90 and held against a respective lateral surface 32 by a nut 96 through a selected transverse clamping bore 36, each clamp member 80 defining a facing inner surface 82 having a frame extension groove 83 extending above the upper support platform 30, wherein a set of slide rails 210 within the slide 200 of the handgun are retained within the upper slide grooves 34 of the upper support platform 30 and held secure by the upper contact tip 52 of each anchor bolt 50 being extended above the upper support platform 30 within a slide channel 205 of the secured slide 200, FIGS. 8 and 11-12, and alternatively, wherein the inverted handgun frame 100, further defining front and rear slide frame extensions 105, is secured within each frame support clamping assembly 70 with each front and rear slide frame extension 105 being captive between the frame extension grooves 83 of each clamp member 80 held in place by the clamp bolt 90 and nut 96, FIGS. 7 and 9-10, securely retaining the handgun frame 100 upon the workpiece 10.

Each clamp member 80, FIGS. 1 and 4-6, further defines an upper section 81, a lower section 84, an inner surface 82 and an outer surface 88, each inner surface 82 further comprising the horizontal frame extension groove 83 in the upper section 81 and a lower aperture 85 through the lower section 84 from the outer surface 88 to an indented platform contact surface 86 on the lower section 84. The lower section 84 is preferably more narrow than the upper section 81, with the upper section 81 extending above the upper support platform 30, allowing the platform contact surface 86 to abut the respective lateral surface 32 of the upper support platform 30 when tightened into place. The clamp bolt 90 further defines an upper end 91 having an expanded head 92 with a tool indentation 93, an outer threaded shaft 94 and an end 95 upon which is placed the nut 96. The bolt 90 is placed through the lower aperture 85 of a paired clamp member 80, through the selected transverse clamping bore 36 suited for the appropriate handgun frame 100, through the lower aperture 85 of the other paired clamp member 80, FIG. 6, and then tightened as the frame extension grooves 83 of the facing clamp sections 80 compress the slide frame extensions 105 of the handgun frame 100, FIG. 10, this clamping occurring on two locations presenting the slide frame extensions 105 on the frame 100 while upon the upper support platform 30 of the workpiece 10, as shown in FIGS. 7 and 9.

The workpiece 10 may be held horizontally within a vise by securing the lower clamping section 22 with the vise mounted upon a stationary platform for tooling and repair or it may be suspended by a threaded shaft of a hook or peg engaged within the axial threaded bore 24 of the L-shaped base member 20 for painting or surface treatment of the frame and slide while held in a vertical orientation. When held within a vise, the workpiece 10 provides an immovable securing means for retaining each frame 100 or slide 200 without movement while conducting operations on the handgun components. It is contemplated that this secure retention will prove useful when performing sight modification, adjustment or replacement, making rollover cuts, adding cocking serrations on the front of the slide, lowering ejection ports, making French side cuts, sanding, surface treatment and polishing with regard to the slide and for making handle grip improvements, texturing and painting.

Placement of the slide 200 within the workpiece 10 as shown in FIGS. 8 and 11-12 consists of separation of the slide 200 from the frame 100 and removal of a spring, action and barrel within the slide 200. The stripped slide 200 is then engaged upon the upper support platform 30 with the slide rails 210 slid into the upper slide grooves 34 on the lateral surfaces 32 from the rear end 220 of the slide 200 to the front 215. Upon reaching a desired location on the upper support platform 30, the lower surface 26 of the L-shaped base member 20 is accessed, FIG. 11, wherein one or more of the anchor bolts 50 are moved upward by rotation of the anchor bolt 50 until the upper contact tip 52 is engaged with the slide channel 205 of the slide 200, FIG. 12, retaining the slide 200 in a fixed position upon the upper support platform 30. To disengage, the anchor bolts 50 are lowered by rotation until the contact tip 52 is returned to a location within the axial channel 38 allowing the slide 200 to be removed from the upper support platform 30.

Placement of the frame 100 requires the placement of the two frame support clamping assemblies 70 upon the upper support platform 30 of the L-shaped base member 20 as shown in FIGS. 1, 6-7, and 9-10. Most generally, the frame 100 is presented as shown in FIG. 9, with at least two pair of slide frame extensions 105, most commonly found in the polymeric composition frame handguns including those marketed by GLOCK®, SMITH & WESSON®, and other manufacturers. In full metal guns, especially those in the 1911 frames, the slide frame extensions 105 may run the full length or most of the length of the handgun frame 100. In either case, the frame support clamping assemblies 70 will engage the slide frame extensions 105 to secure the frame 100 of the handgun as shown in FIGS. 7 and 9. Engagement of the frame 100 within the workpiece 10 would require the placement of the frame support clamping assemblies 70 spaced apart to accept the location of the slide frame extensions 105 of the frame 100, as shown in FIG. 9, by placing each paired clamping members 80 with the inner surfaces 82 of each clamping member 80 facing one another and placing the clamp bolt 90 through the selected transverse clamping bores 36.

It is contemplated that the workpiece 10 may be made from aluminum or other tool friendly metals, including aluminum, titanium or stainless steel, composite plastics and polymers, or cast compositions which would provide suitable stability for the contemplated work activities conducted on the handgun frame and slide. While the workpiece 10 has been particularly shown and described with reference to a preferred embodiment thereof, it will be understood by those skilled in the art that changes in form and detail may be made therein without departing from the spirit and scope of the invention.

What is claimed is:

1. A workpiece held within a vise or clamp and securing a slide and a frame component of a variety of semi-automatic handguns, the workpiece comprising: an L-shaped base member defining a threaded axial bore, an extended lower clamping section serving as a location for securing within a clamp or vise and having a lower surface, said L-shaped base member further extending an upper support platform defining two lateral surfaces including axially aligned upper slide grooves on each said lateral surface and a plurality of aligned transverse clamping bores below said upper slide grooves, said upper support platform further defining an upper axial channel and at least two threaded vertical anchor bores extending from said axial channel to said lower surface of said lower clamping section; at least two anchor bolts having outer threads, each said anchor bolt engaged within a respective vertical anchor bore with an upper contact tip extending through said axial channel and a lower end defining a tool indentation to rotate each said anchor bolt while engaged within each said vertical anchor bore; and a frame support clamping assembly defining at least two pair of clamp members engaging a common clamp bolt and held against a respective said lateral surface by a nut through a selected said transverse clamping bore, each said clamp member defining a facing inner surface having a frame extension groove extending above said upper support platform, wherein a set of slide rails within said slide of said handgun are retained within said upper slide grooves of said upper support platform and maintained secure by said upper contact tip of each said anchor bolt being extended above said upper support platform within a slide channel of said secured slide, and alternatively, wherein said handgun frame, further defining front and rear slide frame extensions, is secured within each said frame support clamping assembly with each said front and rear slide frame extension being secured between said frame extension grooves of each said clamp member held in place by said clamp bolt and nut immovably retaining said handgun frame upon said workpiece.

2. The workpiece as disclosed in claim 1, each said frame support clamping assembly further comprising: each said clamp member defining an upper section, a lower section, an inner surface and an outer surface, each said inner surface further defining said frame extension groove in said upper section and a lower aperture through said lower section from said outer surface to an indented platform contact surface on said lower section, said lower section more narrow than said upper section, with said upper section extending above said upper support platform, allowing said platform contact surface to abut each said respective lateral surface of said upper support platform when tightened into place; and said clamp bolt further defining an upper end having an expanded head with a tool indentation, an outer threaded shaft and an end upon which is placed said nut, wherein said bolt is placed through said lower aperture of one of a pair of said clamp members through one selected said plurality of transverse clamping bore suited for said handgun frame, through said lower aperture of said other paired clamp member and tightened as said frame extension grooves of each said facing frame extension grooves compress said slide frame extensions of said handgun frame, said clamping occurring at two locations where said handgun frame presents said slide frame extensions while mounted upon said upper support platform of said workpiece.

3. The workpiece as disclosed in claim 1, wherein said workpiece is made from a material including aluminum, titanium, stainless steel, composite plastics and polymers, or cast compositions which would provide suitable stability for the contemplated work activities conducted on the handgun frame and slide.

* * * * *